US009478373B2

(12) United States Patent
Välivainio et al.

(10) Patent No.: US 9,478,373 B2
(45) Date of Patent: Oct. 25, 2016

(54) ELECTRIC SWITCH HOUSING

(71) Applicant: ABB OY, Helsinki (FI)

(72) Inventors: Mikko Välivainio, Vaasa (FI); Juha Soldan, Vaasa (FI); Jari Elomaa, Vaasa (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 14/784,449

(22) PCT Filed: Apr. 15, 2013

(86) PCT No.: PCT/FI2013/050412

§ 371 (c)(1),
(2) Date: Oct. 14, 2015

(87) PCT Pub. No.: WO2014/170529

PCT Pub. Date: Oct. 23, 2014

(65) Prior Publication Data

US 2016/0181029 A1 Jun. 23, 2016

(51) Int. Cl.

| | |
|---|---|
| ***H01H 19/04*** | (2006.01) |
| ***H01H 33/08*** | (2006.01) |
| ***H01H 19/10*** | (2006.01) |

(52) U.S. Cl.

CPC ..... *H01H 19/04* (2013.01); *H01H 19/10* (2013.01); *H01H 33/08* (2013.01)

(58) Field of Classification Search

CPC ..... H01H 9/342; H01H 2077/025; H01H 33/08; H01H 39/006; H01H 50/546; H01H 71/02; H01H 89/00; H01H 1/385; H01H 2033/908; H01H 33/04; H01H 33/10; H01H 33/7015; H01H 33/7023; H01H 33/7084

See application file for complete search history.

(56) References Cited

U.S. PATENT DOCUMENTS

| | | | | |
|---|---|---|---|---|
| 4,077,024 A * | 2/1978 | Lisnay | H01H 71/1009 | 335/10 |
| 4,430,631 A * | 2/1984 | Forsell | H01H 73/18 | 218/32 |
| 5,245,302 A * | 9/1993 | Brune | H01H 71/405 | 335/23 |
| 5,581,063 A * | 12/1996 | Clark | H01H 9/34 | 218/146 |
| 5,608,198 A * | 3/1997 | Clark | H01H 9/302 | 218/147 |

(Continued)

FOREIGN PATENT DOCUMENTS

| | | |
|---|---|---|
| GB | 2178596 A | 2/1987 |
| JP | H09171762 A | 6/1997 |
| WO | 2012168555 A1 | 12/2012 |

OTHER PUBLICATIONS

National Board of Patents and Registration of Finland, International Search Report issued in International Patent Application No. PCT/FI2013/050412 dated Jul. 17, 2013, 6 pp.

*Primary Examiner* — Truc Nguyen
(74) *Attorney, Agent, or Firm* — Taft Stettinius & Hollister LLP

(57) ABSTRACT

A rotary switch housing (100), comprising a bottom wall (102) for mounting of the switch housing (100) to a mounting base, and side walls (104, 106) extending from the bottom wall (102), the switch housing further comprising an arc chamber (120) for extinguishing an electric arc, and a gas exhaust channel (130) for exhausting gas developed in the arc chamber (120) out of the housing (100). The gas exhaust channel (130) comprises a guiding portion (130A), which is substantially parallel to a side wall (106) of the housing (100) for leading the gases to a direction away from the bottom wall (102) of the housing (100).

20 Claims, 3 Drawing Sheets

(56) References Cited

U.S. PATENT DOCUMENTS 6,037,555 A * 3/2000 Castonguay ..... H01H 1/2058 200/306
6,750,743 B1 6/2004 Subramanian et al.
9,159,508 B2 * 10/2015 Rival ..... H01H 9/342
2009/0194510 A1 8/2009 Dahl
2010/0243610 A1 9/2010 Scola et al.
2011/0079583 A1 * 4/2011 Chen ..... H01H 9/40 218/154
2012/0175348 A1 7/2012 Anglade et al.

* cited by examiner

ELECTRIC SWITCH HOUSING

FIELD

The present invention relates to an electric switch housing.

BACKGROUND

An arc emerges when the contacts of an electric switch are disconnected from each other. Gas produced by the arc is to be exhausted from the housing.

Various solutions have been tried to exhaust the gases from the housing but there is still room for improvement for the gas exhaust arrangements.

SUMMARY

An object of the present invention is to provide a switch so as to alleviate the above disadvantages. The object of the invention is achieved with a switch housing, which is defined in the independent claim. Some embodiments are disclosed in the dependent claims.

DRAWINGS

In the following, the invention will be described in greater detail by means of some embodiments with reference to the accompanying drawings, in which FIG. 1 shows an embodiment of a housing having a gas exhaust arrangement;

DETAILED DESCRIPTION

Figure 1:
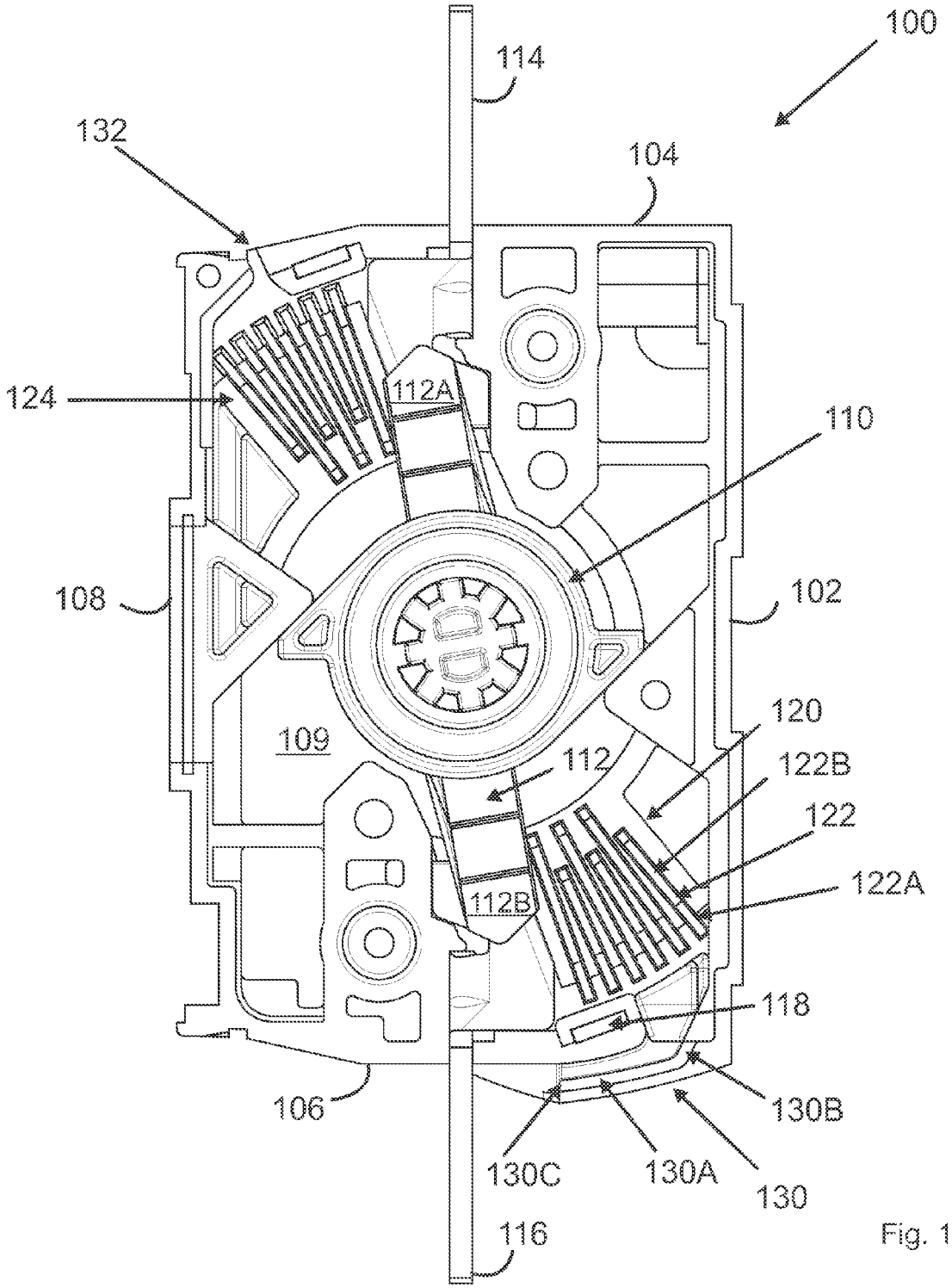

A rotary electric switch may comprise a plurality of switch modules, which are stacked together. Each switch module may comprise two halves that are settable against each other. FIG. 1 shows an example of a half of a housing module. The other half (not shown) may be a mirror image of the half shown in the figure. The module half 100 shown in FIG. 1 is called a rotary switch housing or housing in the following.

The housing 100 comprises a bottom wall 102, which serves as a mounting base for mounting the housing to a rail, for instance. The direction of the bottom wall is called as "horizontal direction" in the following. The housing also comprises side walls 104 and 106, which are substantially perpendicular to the bottom wall. The top wall 108 is parallel to the bottom wall.

It can be seen that the walls may have small indentations, such as the bottom wall has an indentation in the middle usable in mounting purposes of the housing. The walls, such as the side walls 104 and 106 are not completely straight in FIG. 1 but have portions that diverge from the vertical direction. However, on a coarse level the housing may be considered as having a substantially rectangular form, wherein the bottom wall and side walls are substantially horizontal and parallel to each other, and the side walls are substantially vertical, and mutually substantially parallel to each other.

The housing is arranged to house a rotary actuator 110. The rotary actuator is used for rotating a rotary contact 112. The rotary contact may, for example, be such that is pushed through the rotary actuator as in FIG. 1. The rotary contact may thus be a longitudinal contact blade that extends to both sides of the rotary actuator 110.

The housing also comprises spaces for two stationary contacts 114, 116. The stationary contacts may be at the opposite ends of the housing, substantially at the middle of the housing in vertical direction. The rotary contact blade serves in making and breaking an electrical contact between the stationary contacts. When the rotary actuator 110 is turned clockwise, the ends 112A, 1128 of the contact blade make contacts with the respective stationary contacts 114 and 116. Turning of the rotary actuator counter-clockwise causes the contact blade to disconnect from the stationary contacts at both ends of the contact blade.

When the rotary contact is disconnected from the stationary contacts, an arc is formed at each disconnection point. That is, an arc is formed at both ends 112A, 1128 of the rotary contact blade 112.

For the purpose of extinguishing the arcs, there are provided an arc chamber at the proximity of the area, where the contact blade disconnects from the stationary contacts. At a first end of the housing, there is provided an arc chamber 120 for extinguishing an arc formed by disconnection of the rotary contact end 1128 from the stationary contact 116, and at a second end of the housing, there is provided an arc chamber 124 for extinguishing an arc formed by disconnection of the rotary contact end 112A from the stationary contact 114.

Each arc chamber may comprise one or more arc plates 122. In FIG. 1, each chamber has 6 plates therein. Each plate has a base portion 122A, and at least one side portion 122B. The plates may have a U-form, for instance, having two side portions or branches 122B. The propagation path of the arc is substantially transverse to the longitudinal direction of the branch.

The housing may also comprise a permanent magnet 118 for directing the arc. In FIG. 1, the permanent magnet is arranged such that directs the arc towards one of the branches of the arc plates.

It can be seen that the arc chambers 120, 124 are placed to opposite corners of the substantially rectangular housing 100. The first chamber 120 is placed to a corner of the housing that is close the bottom wall 102 of the housing, and the second chamber 124 is further away from the bottom wall 102 than the first chamber.

In the arc chambers, the extinguishing of the arc produces gas that needs to be exhausted from the housing 100. There is provided a gas exhaust channel 130, 132 in the proximity of each arc chamber. However, as can be seen from FIG. 1, the gas exhaust channels are placed and shaped mutually differently. The first gas exhaust channel 130 that is located close to the first arc chamber 120 is placed vertically in the lower half of the housing 100 whereby it is relatively close to the bottom wall 102. The second gas exhaust channel 132 is vertically in the top half of the housing, whereby it is relatively far away from the bottom wall 102.

FIG. 1 shows that the gas exhaust channels are positioned behind the arc plates, that is, behind the bases 122A of the arc plates. In the case of U-shaped arc plates, the arc propagates between the U-branches. When gas is formed, it can pass between the bases 122A of the plates 122 to the exhaust channel 130.

The second gas exhaust channel is arranged close to the corner between the side wall 104 and the top wall 108. In the shown embodiment, the outlet opening leading out of the housing is arranged to the top part of the side wall 104. Alternatively, it could be close to the end of the top wall 108.

The second exhaust channel may be substantially in 45 degree angle with respect to the side wall 104 and the top wall. Thus, the gases exhausted via the channel are led to a direction that is away from the base. This is important, as the conductive gases are in different electrical potential than the mounting rail to which the housing is mounted to, and an arc could emerge if the gases could contact the base.

The first gas exhaust channel 130 resides physically close to the bottom wall, and there is risk that gases react electrically with the mounting rail. The first gas exhaust channel comprises therefore a guiding portion 130A, which is substantially parallel to the side wall 106. The guiding portion 130A is thus substantially vertical leading away from the bottom wall 102. At the end of the guiding portion, there is provided an outlet opening leading the gases away from the housing 100. The gases are thereby led towards the stationary contact 116 that is partly residing exterior of the housing. This can be permitted as the gases and the stationary contact are in the same electrical potential.

The first gas exhaust channel 130 may also comprise an inlet portion 130B, which is divergent from the guiding portion 130A. The inlet portion 130B and the guiding portion 130A may be arranged about 45 degrees angle to each other.

The gas exhaust channel may be arranged as an indentation/recess to the side wall of the housing.

Figure 2:
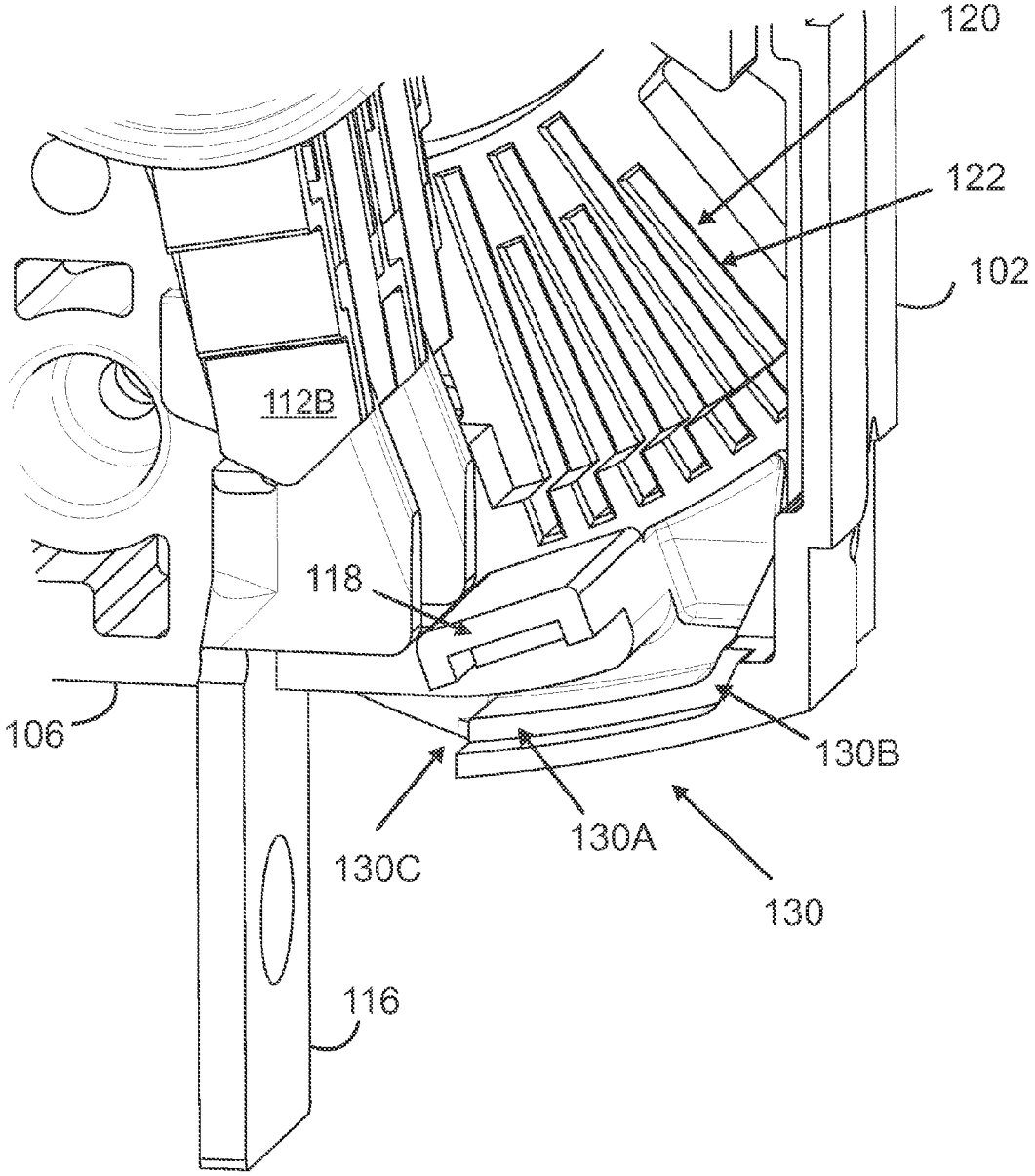
FIG. 2 shows a more detailed view of the gas exhaust arrangement.

FIG. 2 shows a more specified view of the housing 100 at the proximity of the first arc chamber 120, which is located in a housing corner of a bottom wall 102 and a side wall 106. The arc chamber houses a plurality of arc plates for extinguishing an arc emerging from the disconnecting of the rotary contact end 1128 from the first stationary contact 116.

There is arranged a gas exhaust channel 130 in the housing for exhausting gas generated in the arc chamber 120 due to extinguishing of the arc. The gas exhaust channel 130 is located in the corner of the housing. It is arranged behind the arc plates when seen from the geometrical centre point of the housing module or the rotation axis of the rotary contact.

The gas exhaust channel comprises a portion, which leads the gases away from the bottom wall. The gas exhaust channel may thus have a portion which is substantially perpendicular to the bottom wall. The portion of the gas exhaust channel is thus substantially parallel to the side wall of the housing.

The exhaust channel may also comprise an inlet portion. This refers to the vertically lowest portion of the housing, which is arranged into an angle with respect to the side wall 106.

The exhaust channel may be arranged as a recess in the bottom and/or side walls of the housing. The channel may be such that it enlarges towards the outlet 130C.

Figure 3:
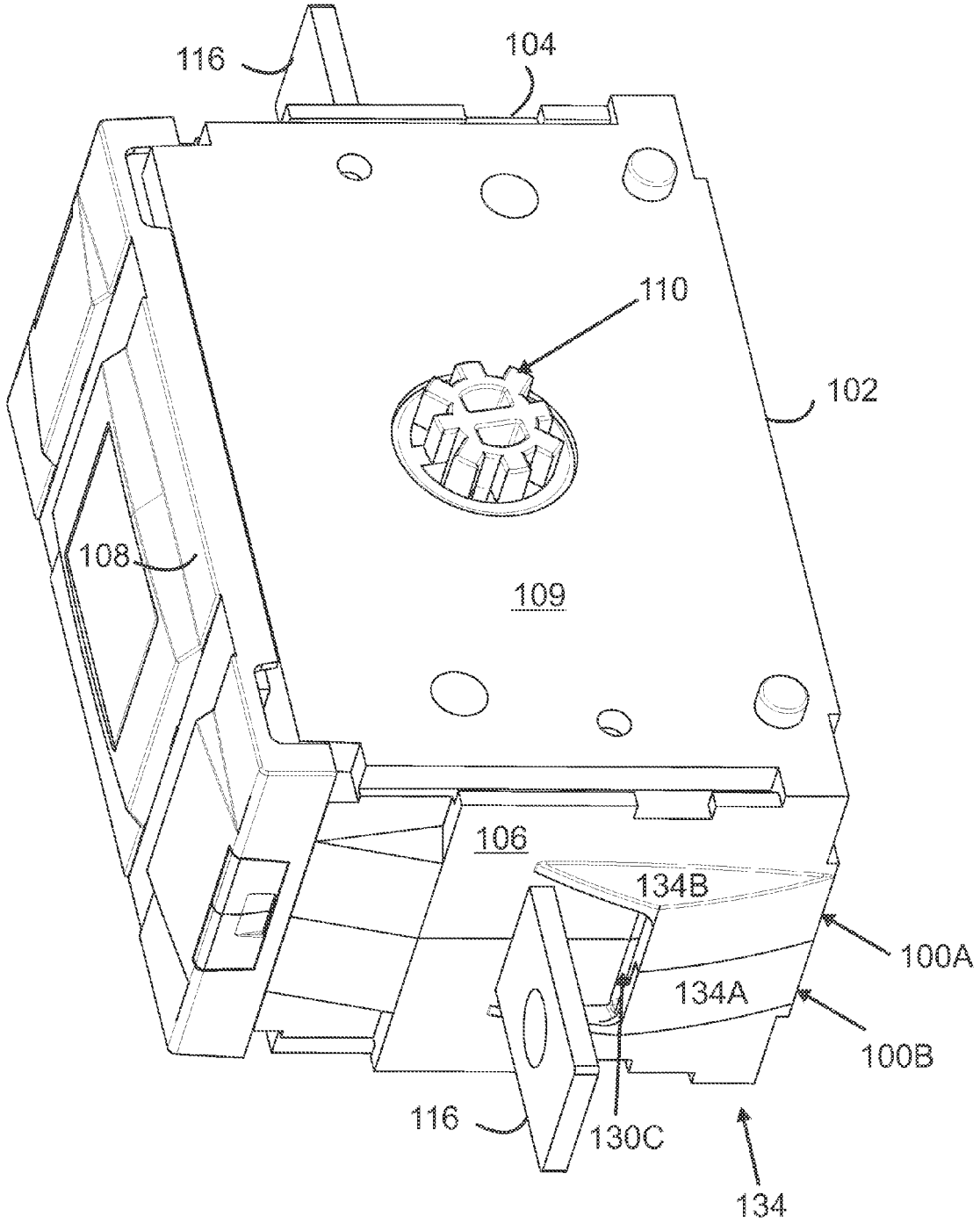
FIG. 3 shows a housing module, where the housing halves have been put together.

FIG. 3 shows a view of a complete housing module. The module comprises two module halves 100A, 1008, which have been mounted together. The modules halves may be mutually symmetric, and be mirror-images of each other. Parts of the stationary contacts 114, 116 lie exterior of the housing module when mounted. The outside portions of the stationary contacts are connection portions for connecting the stationary contact to external conductors.

As can be seen, the housing comprises a gas shield 134 for limiting the gas flow outside the housing. The gas shield may comprise a front wall for preventing the gas exhausted from the outlet opening 130C to flow to perpendicular direction from the side wall. Furthermore, the gas shield 134 may comprise side portions 134 for preventing gas flow to a direction perpendicular to the end wall of the housing.

It will be obvious to a person skilled in the art that, as the technology advances, the inventive concept can be implemented in various ways. The invention and its embodiments are not limited to the examples described above but may vary within the scope of the claims.

The invention claimed is:

1. A rotary switch housing, comprising a bottom wall for mounting of the switch housing to a mounting base, and side walls extending substantially perpendicularly from the bottom wall, the switch housing comprising spaces for receiving two stationary contacts, and a space for receiving a rotary contact for serving as a contact bridge between the stationary contacts, the switch housing further comprising an arc chamber for extinguishing an electric arc, and a gas exhaust channel for exhausting gas developed in the arc chamber out of the housing, the switch housing comprises, in vertical direction, a bottom half having the bottom wall, and a top half above the bottom half, which gas exhaust channel is arranged to the bottom half of the housing, wherein stationary contacts are arranged substantially at the middle of the housing in the vertical direction, the gas exhaust channel comprises a guiding portion, which is substantially parallel to a side wall of the housing for leading the gases to a direction away from the bottom wall of the housing, the gas exhaust channel further comprising an outlet for outletting the gases out of the housing, which guiding portion and outlet are arranged to guide the gases towards the first stationary contact residing partly outside of the housing, and the gas exhaust channel is made as a recess to a side wall of the housing.

2. A rotary switch housing according to claim 1, wherein the housing comprises a first arc chamber for extinguishing an arc formed by disconnecting of a first end of the rotary contact and a first stationary contact, and a second arc chamber for extinguishing an arc formed by disconnecting a second end of the rotary contact and a second stationary contact.

3. A rotary switch housing according to claim 1, wherein the first arc chamber is closer to the bottom wall of the housing than the second arc chamber.

4. A rotary switch housing according to claim 1, wherein each of the arc chambers comprises spaces for receiving arc plates, which arc plates have a base and two branches extending from the base, wherein the guiding portion is substantially perpendicular to the longitudinal direction of the branches of the arc plates.

5. A rotary switch housing according to claim 1, wherein the arc chambers are at opposite corners of the substantially rectangular housing.

6. A rotary switch housing according to claim 1, wherein the housing is substantially rectangular.

7. A rotary switch housing according to claim 1, wherein housing comprises a second gas exhaust channel for exhausting gas created in the second extinguishing chamber, which second gas exhaust channel is substantially perpendicular to a side wall of the housing).

8. A rotary switch housing according to claim 1, wherein the first gas exhaust channel comprises an inlet portion for inletting gas from the exhaust chamber to the guiding portion, which inlet portion is divergent from the guiding portion.

9. A rotary switch housing according to claim 1, wherein the dimension of the guiding channel is arranged to increase towards the outlet of the channel.

10. A rotary switch housing according to claim 1, wherein when the rotary contact is contacted to the stationary contacts, the rotary contact is substantially parallel to the bottom wall of the housing, and when the rotary contact is disconnected from the stationary contacts, the first end of the rotary contact turns towards the bottom wall, and the second end of the rotary contact turns away from the bottom wall.

11. A rotary switch housing according to claim 2, wherein the first arc chamber is closer to the bottom wall of the housing than the second arc chamber.

12. A rotary switch housing according to claim 3, wherein each of the arc chambers comprises spaces for receiving arc plates, which arc plates have a base and two branches extending from the base, wherein the guiding portion is substantially perpendicular to the longitudinal direction of the branches of the arc plates.

13. A rotary switch housing according to claim 3, wherein the arc chambers are at opposite corners of the substantially rectangular housing.

14. A rotary switch housing according to claim 4, wherein the arc chambers are at opposite corners of the substantially rectangular housing.

15. A rotary switch housing according to claim 2, wherein housing comprises a second gas exhaust channel for exhausting gas created in the second extinguishing chamber, which second gas exhaust channel is substantially perpendicular to a side wall of the housing.

16. A rotary switch housing according to claim 4, wherein housing comprises a second gas exhaust channel for exhausting gas created in the second extinguishing chamber, which second gas exhaust channel is substantially perpendicular to a side wall of the housing.

17. A rotary switch housing according to claim 3, wherein housing comprises a second gas exhaust channel for exhausting gas created in the second extinguishing chamber, which second gas exhaust channel is substantially perpendicular to a side wall of the housing.

18. A rotary switch housing according to claim 2, wherein the first gas exhaust channel comprises an inlet portion for inletting gas from the exhaust chamber to the guiding portion, which inlet portion is divergent from the guiding portion.

19. A rotary switch housing according to claim 4, wherein the first gas exhaust channel comprises an inlet portion for inletting gas from the exhaust chamber to the guiding portion, which inlet portion is divergent from the guiding portion.

20. A rotary switch housing according to claim 2, wherein when the rotary contact is contacted to the stationary contacts, the rotary contact is substantially parallel to the bottom wall of the housing, and when the rotary contact is disconnected from the stationary contacts, the first end of the rotary contact turns towards the bottom wall, and the second end of the rotary contact turns away from the bottom wall.

* * * * *